United States Patent [19]

Hirota

[11] 4,256,224

[45] Mar. 17, 1981

[54] NESTABLE AND STACKABLE SIX-BOTTLE CARRIER

[75] Inventor: Kashichi Hirota, Hachioji, Japan

[73] Assignee: Kyowa Electric & Chemical Co., Ltd., Tokyo, Japan

[21] Appl. No.: 70,168

[22] Filed: Aug. 27, 1979

[51] Int. Cl.[3] ..... B65D 1/38; B65D 1/24; B65D 21/02; B65D 25/04

[52] U.S. Cl. ..... 206/203; 206/505; 206/507; 206/427; 206/518; 220/21; 220/94 A

[58] Field of Search ..... 206/203, 427, 505, 507, 206/518; 220/21, 23.6, 94 A

[56] References Cited

U.S. PATENT DOCUMENTS

| | | | |
|---|---|---|---|
| 2,878,959 | 3/1959 | Nawman | 206/505 |
| 3,409,163 | 11/1968 | Lockwood | 206/505 |
| 3,991,879 | 11/1976 | Hiroto | 206/203 |
| 4,095,720 | 6/1978 | Delbrouck et al. | 206/203 |

*Primary Examiner*—William T. Dixson, Jr.

*Attorney, Agent, or Firm*—Newton, Hopkins & Ormsby

[57] ABSTRACT

A lightweight, tough and durable bottle carrier is molded as a unit from high density plastics, is nestable with like carriers, and is stackable in two orthogonal directions with like carriers. The carrier has a central lifting handle flush with the top edge thereof and has plural discrete bottle cells in two rows on opposite sides of the handle. End stacking projections and cross stacking recesses are provided at the bottom of the carrier as well as individual bottle centering elements. Convenience and high versatility are featured. The carrier may be received in shallow or full depth, open or pocketed, cases.

16 Claims, 10 Drawing Figures

NESTABLE AND STACKABLE SIX-BOTTLE CARRIER

BACKGROUND OF THE INVENTION

The persistent need exists for more convenient, economical and efficient bottle carriers in the soft drink industry. In particular, there is a need for improved carriers for the one liter, thin wall, resilient bottles now coming into wide usage. The present invention seeks in particular to satisfy this latter need.

Among the significant improvement features embodied in the invention are compactness and minimum bulk and weight in a strong and durable molded plastics unit which can be nested and stacked in two orthogonal directions. A further feature resides in individual separated and tapered bottle cells depending from a sturdy top frame having a center handle bar flush with the top edge of the frame and forming the anchor for the two inner rows of legs or struts forming the cells.

Other important features include bottle centering bases for the cells carried by the depending struts and cell dividers which are curved to assist in bottle centering by a cam-like action. Opposite end paired stacking projections at the bottom of the carrier allow easy longitudinal stacking, while bottom channel recesses facilitate cross stacking and interlocking with like carriers. The carrier is also constructed for ease of separation without binding when nested.

Other features of the invention will become apparent during the course of the following detailed description.

Many types of bottle carriers made from various materials exist in the prior art but none of these possesses the above-noted features of the present invention and none has the flexibility of use possessed by the invention. Nestable and stackable carriers are also known in the prior art but not in terms of a bottle carrier having the other noted features and functional capabilities of this invention.

The below-listed prior United States patents of some general interest are made of record herein under 37 C.F.R. 1.56:

U.S. Pat. Nos. 2,889,072, 3,191,796, 3,319,799, 3,420,402, 3,587,915, 3,991,879, 4,040,517.

DETAILED DESCRIPTION

Figure 1:
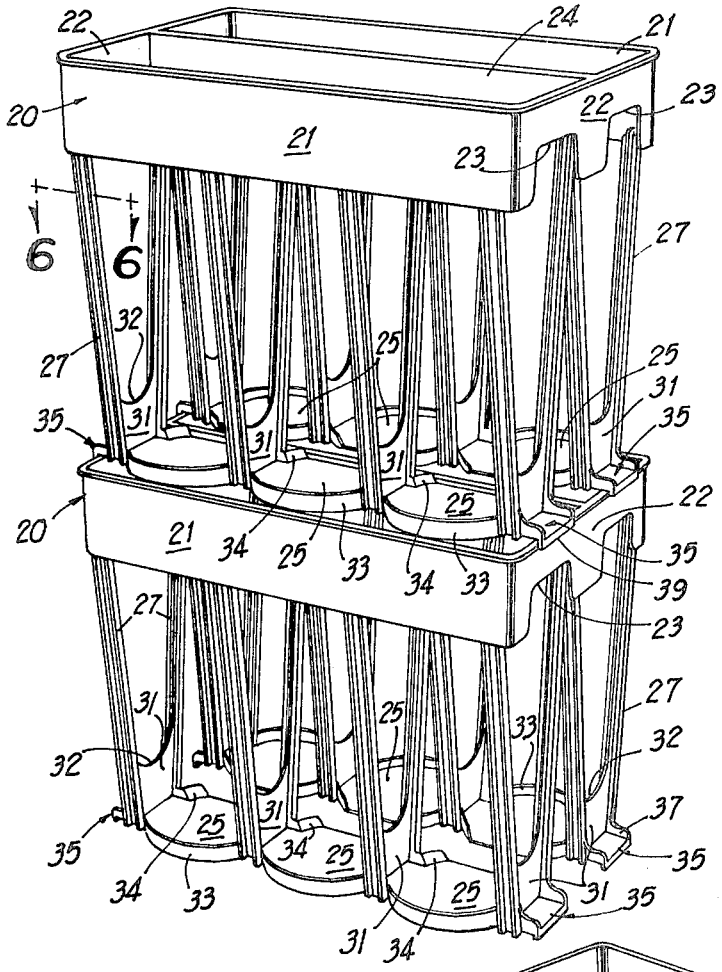
FIG. 1 is a perspective view of a six-bottle carrier according to the invention in stacked relation with an identical carrier.
Figure 2:
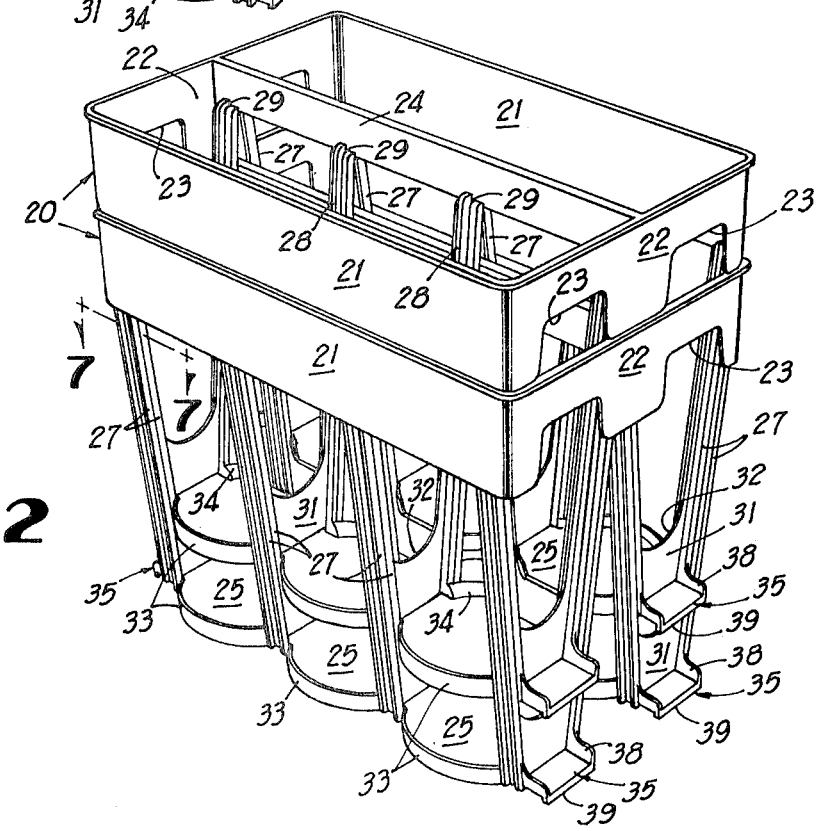
FIG. 2 is a perspective view of the same two bottle carriers in nested relationship.

Referring to the drawings in detail wherein like numerals designate like parts, a unitary six cell bottle carrier preferably molded from durable high density polyethylene includes a top substantially rectangular frame 20 of good rigidity and strength and having united vertical side and end walls 21 and 22, the end walls having pairs of clearance notches 23 formed in their lower edges, for a purpose to be described. A longitudinal handle bar 24 for the bottle carrier is disposed at the transverse center thereof in parallel relationship to the frame side walls 21 and having its opposite ends joined to the end walls 22. As clearly shown in FIGS. 5 and 8, the handle bar 24 is of deep inverted channel formation for the sake of strength and rigidity.

Figure 4:
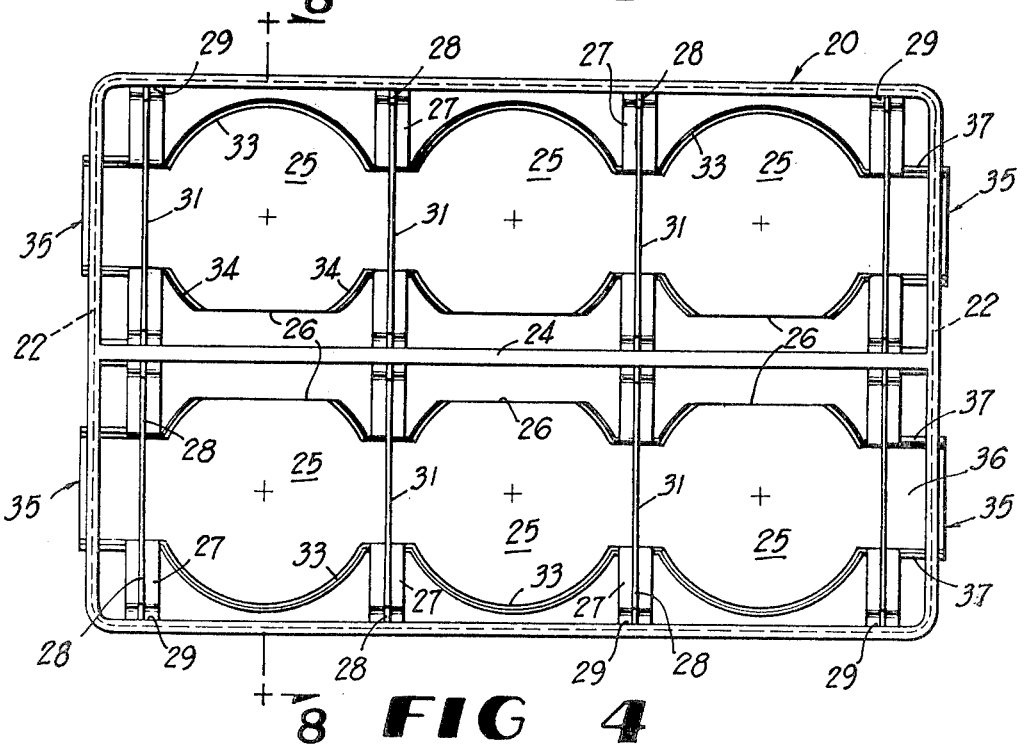
FIG. 4 is a top plan view of the bottle carrier.
Figure 5:
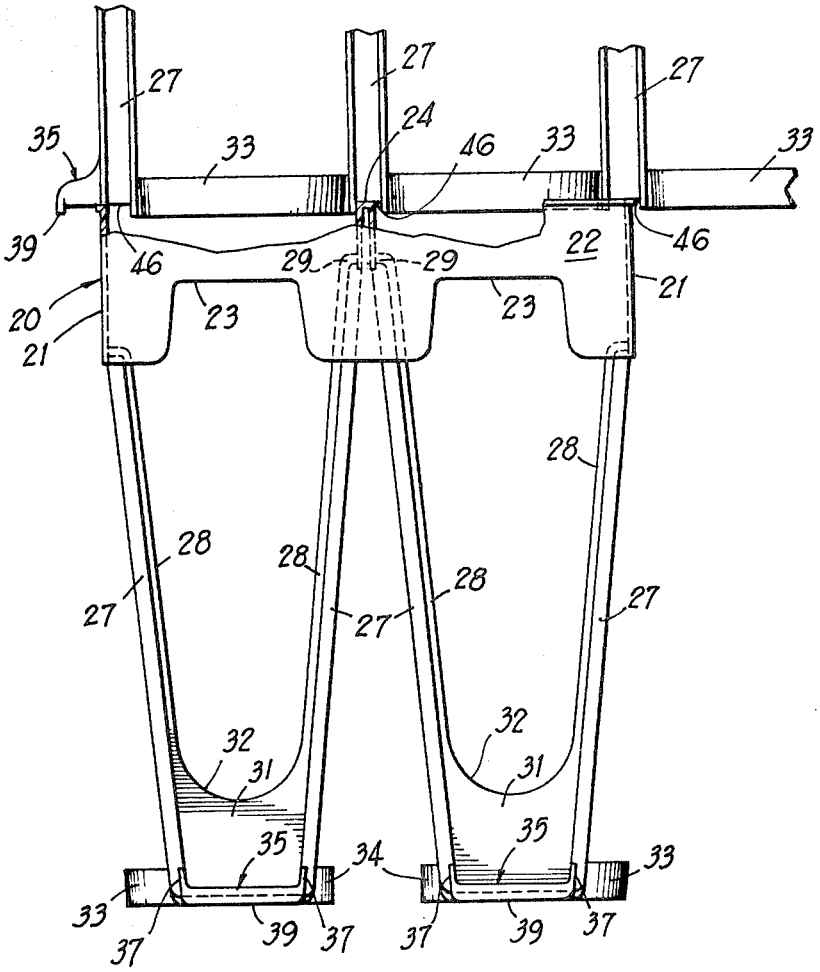
FIG. 5 is an elevational view, partly broken away and partly in cross section, showing the cross stacking capability of the bottle carrier.
Figure 6:
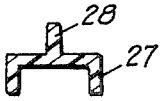
FIG. 6 is a horizontal section taken on line 6—6 of FIG. 1.
Figure 7:
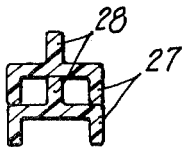
FIG. 7 is a similar section taken on line 7—7 of FIG. 2.
Figure 8:
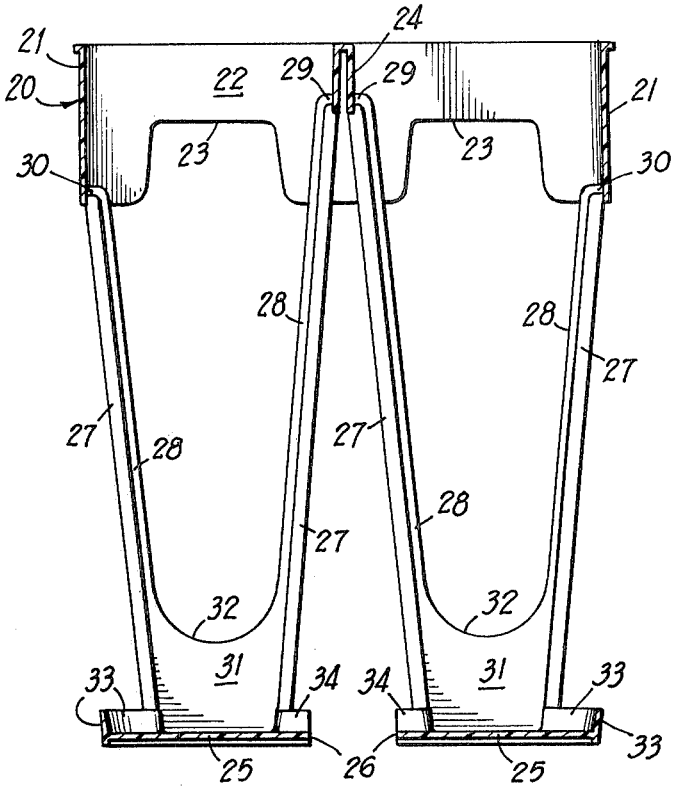
FIG. 8 is a transverse vertical section taken on line 8—8 in FIG. 4.
Figure 9:
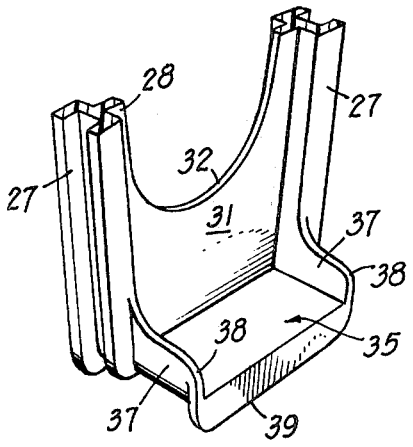
FIG 9 is a fragmentary perspective view of one end stacking projection and associated parts.
Figure 10:
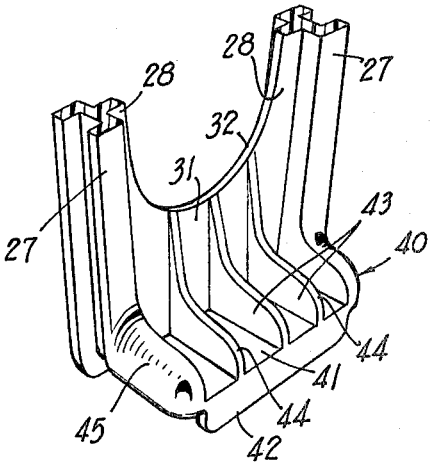
FIG. 10 is a similar view of a modified form of stacking projection or support.

The bottle carrier further comprises in the illustrated embodiment six discrete bottle receptor cells arranged in two longitudinal rows of three cells each on opposite sides of the handle bar 24 and between the handle bar and the two side walls 21 of upper frame 20. Each bottle cell comprises a horizontal flat bottom wall or base 25 which is disc-like including a straight longitudinal interior edge 26 and a circularly curved exterior edge or margin, as clearly shown in FIG. 4. The interior straight edges 26 are aligned longitudinally of the carrier and are spaced laterally equidistantly from a vertical plane through the carrying handle bar 24. The construction imparts clear separation and lateral spacing of the lower ends of the bottle cells in the two longitudinal rows, as shown in FIGS. 5 and 8, such lower ends being defined by the disc-like bases 25.

Figure 3:
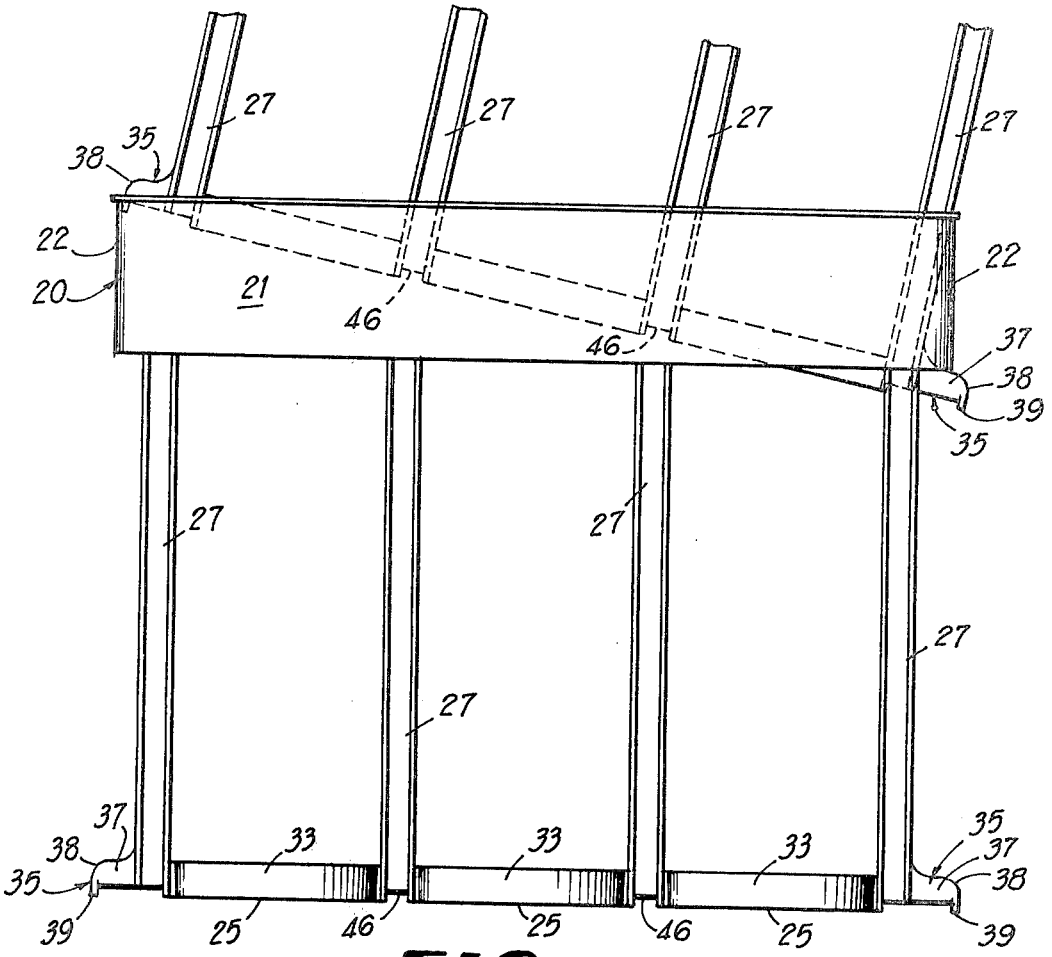
FIG. 3 is a fragmentary side elevation of the two carriers showing a tilting procedure in the process of nesting the carriers.

Each cell of the bottle carrier comprises four legs or struts 27 of outwardly opening channel cross section including an interior side longitudinal stiffening rib 28. The center or intermediate bottle cell in the two longitudinal rows share the interior legs or struts 27 of the end or outermost cells of the two rows for the sake of simplicity and reduction of material utilized in the bottle carrier. As viewed from the side, FIG. 3, the several cell struts 27 are parallel and vertical but they are downwardly converging in the two discrete rows of cells to facilitate nesting of the carriers, as best shown in FIGS. 5 and 8.

The top ends of the interior struts 27 in the rows are integrally joined with opposite sides of the handle bar 24 as at 29 while the top ends of the exterior struts in the rows are similarly joined at 30 to the interior faces of frame side walls 21 near the bottom edge of the frame. Thus, the interior and exterior legs or struts 27 for the two rows of cells are of unequal lengths, FIG. 8, with the exterior struts being shorter than the interior struts.

Partial vertical cell divider webs 31 having circularly curved top edges 32 are formed intergrally with the ribs 28 in the vertical planes of the ribs. When cylindrical bottles are placed in the cells, the curved edges 32 exert a camming action on the bases of the bottles to assist in centering the bottles in the cells. For a similar purpose, shallow rising circularly curved flanges 33 at the outer margins of the cell bases 25 and partial or segmental curved flanges 34 at the ends of the straight edges 26 of the bases cooperate in centering the bottoms of the bottles or other containers in the discrete cells of the carrier.

It should be noted that the disc-like bases 25 of the several bottle cells lie in a common horizontal plane 2. A nestable and stackable bottle carrier as defined in claim 1, wherein said top marginal frame has vertically disposed side and end walls whose top and bottom edges lie somewhat outwardly of the tops of the outer struts in said rows of cells whereby when the bottle carrier is nested with a like carrier the bottom edges of said frame of the interior carrier rest solidly on the top edge of the frame of the exterior carrier.

3. A nestable and stackable bottle carrier as defined in claim 1, and each level base having a rising arcuate marginal flange extending at least partly around it for the purpose of centering each bottle in the carrier.

4. A nestable and stackable bottle carrier as defined in claim 3, and a vertical divider web between each adjacent pair of cells in said rows at least near the bases of the cells and having an arcuate top edge which also aids in centering bottles in the cells as they are placed downwardly into the cells.

5. A nestable and stackable bottle carrier as defined in claim 1, and said bottle carrier having spaced transverse recesses in its bottom to receive and interlock with the top of said carrying handle bar and one longitudinal edge of said frame of an underlying bottle carrier whereby the carrier is cross stackable with a like bottle carrier with the longitudinal axis of one carrier arranged transversely of the longitudinal axis of the other carrier.

6. A nestable and stackable bottle carrier as defined in claim 1, and each bottom stacking projection having an outer downturned lip joined to a horizontal wall of the projection to promote the stable positioning of one bottle carrier on another in stacked relationship.

7. A nestable and stackable bottle carrier as defined in claim 6, and each bottom stacking projection having upstanding flanges above said horizontal wall including rounded outer corners.

8. A nestable and stackable bottle carrier as defined in claim 1, and said clearance openings comprising spaced downwardly opening notches in the bottom edges of said frame ends.

9. A nestable and stackable bottle carrier as defined in claim 1, and said carrying handle bar comprising an inverted channel bar having side webs, said inner pairs of struts being joined to the outer faces of said side webs of said carrying handle bar.

10. A nestable and stackable bottle carrier as defined in claim 1, and said struts all comprising channel members having outwardly facing channel passages throughout their lengths.

11. A nestable and stackable bottle carrier as defined in claim 1, and said bottle carrier being molded in its entirety from high density polyethylene.

12. A nestable and stackable bottle carrier as defined in claim 1, and the bottom of the bottle carrier being open between said rows of cells and around the cells except in the areas occupied by the level bases of the cells.

13. A nestable and two way stackable unitary bottle carrier formed of molded plastics and comprising a top substantially rectangular frame having vertical side and end walls, the end walls of the frame having notches in their bottom edges, a center longitudinal carrying handle bar extending between and joined to said end walls, two longitudinal rows of bottle cells including plural cells in each row dependingly secured to said frame and carrying handle bar and including cell base plates in a common level plane for the support of bottles in said cells, said cell base plates being separated at least laterally across said rows, and opposite end stacking projections carried by the endmost cells in said rows substantially at the common level plane and adapted to rest on the top edges of the end walls of said frame when the carrier is stacked on an underlying like carrier, said notches adapted to receive said stacking projections during tilting of the bottle carrier in the process and nesting it within an underlying like carrier.

14. A nestable and two way stackable unitary bottle carrier formed of molded plastics as defined in claim 13, and the bottom of the bottle carrier as defined by said cell base plates having transverse locator recesses between the base plates to allow cross stacking of the bottle carrier with a like carrier by interlocking engagement of one top frame edge and the top edge of said carrying handle bar of an underlying carrier within said transverse locator recesses.

15. A nestable and stackable bottle carrier comprising a top frame having side and end walls, a carrying handle joined to said frame, bottle cells dependingly secured to said frame and including cell base plates in a common level plane for the support of bottles in said cells, and opposite end stacking projections substantially at the common level plane and adapted to rest on the top end walls of an underlying like carrier when said carrier is stacked thereon, said end walls being adapted to allow said stacking projections to move thereunder during tilting of the bottler carrier for nesting it within an underlying like carrier.

16. A nestable and stackable bottle carrier as defined in claim 15, and the bottom of the bottle carrier having transverse locator means to allow cross stacking of the bottle carrier with a like carrier by interlocking engagement of one top frame edge of an underlying carrier with said transverse locator means.

* * * * *